United States Patent [19]

Gill

[11] Patent Number: 5,012,225

[45] Date of Patent: Apr. 30, 1991

[54] SYSTEM FOR DEACTIVATING A FIELD-SENSITIVE TAG OR LABEL

[75] Inventor: Peter Gill, Long Valley, N.J.

[73] Assignee: Checkpoint Systems, Inc., Thorofare, N.J.

[21] Appl. No.: 451,294

[22] Filed: Dec. 15, 1989

[51] Int. Cl.[5] ..... G08B 13/18

[52] U.S. Cl. ..... 340/572

[58] Field of Search ..... 340/572

[56] References Cited

U.S. PATENT DOCUMENTS

| | | | |
|---|---|---|---|
| 3,645,528 | 2/1972 | Cornell | 340/572 |
| 4,413,254 | 11/1983 | Pinneo et al. | 340/572 |
| 4,498,076 | 2/1985 | Lichtblau | 340/572 |
| 4,567,473 | 1/1986 | Lichtblau | 340/572 |
| 4,778,552 | 10/1988 | Benge et al. | 340/572 |

*Primary Examiner*—Glen R. Swann, III

*Attorney, Agent, or Firm*—Weiser & Stapler

[57] ABSTRACT

A field-sensitive tag or label incorporates a layer for mechanically deactivating the tag resulting from subsequent use of the article to which the tag has been applied. To this end, a layered tag is provided which, in addition to the layers which are traditionally provided to achieve the function of a resonant circuit (e.g., substrate and etched outer layers), further incorporates a circuit-deactivating layer which preferably takes the form of an abrasive substance disposed in a suitable binder. The resulting layer can then operate to mechanically deactivate the tag by damaging at least a portion of the resonant circuit which comprises the tag due to movement of the article in subsequent use. The field-sensitive tag of the present invention is advantageously applied to footwear in regions where flexure of the tag can be anticipated, preferably in the sole, making the article well suited to placement in a self-service retail setting while maintaining an adequate degree of security.

20 Claims, 2 Drawing Sheets

FIG. 1
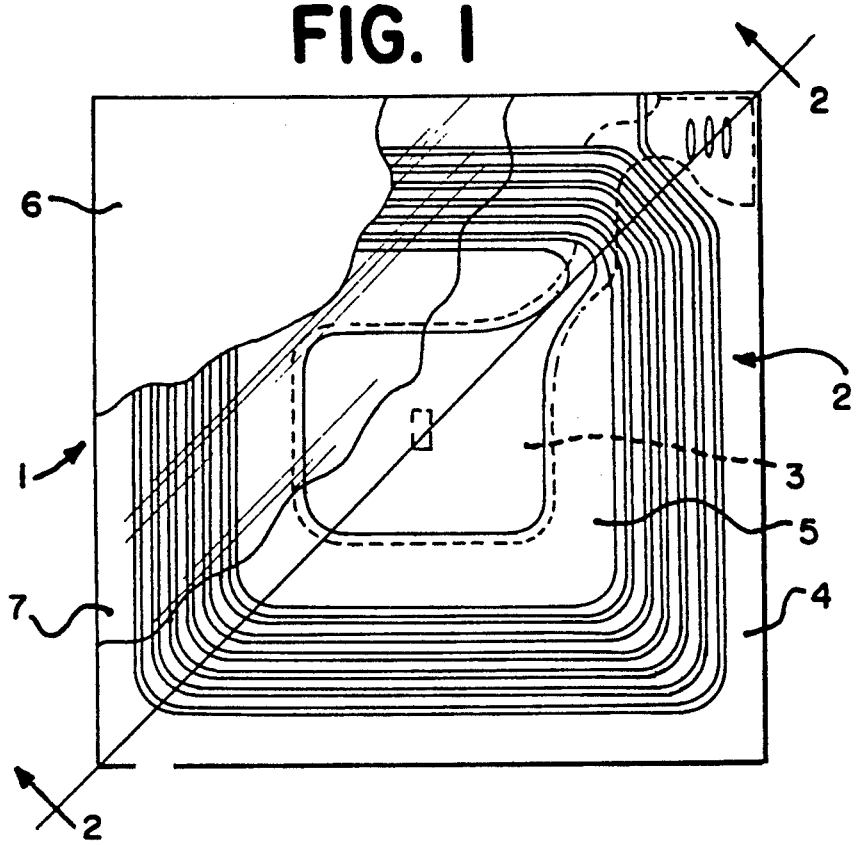
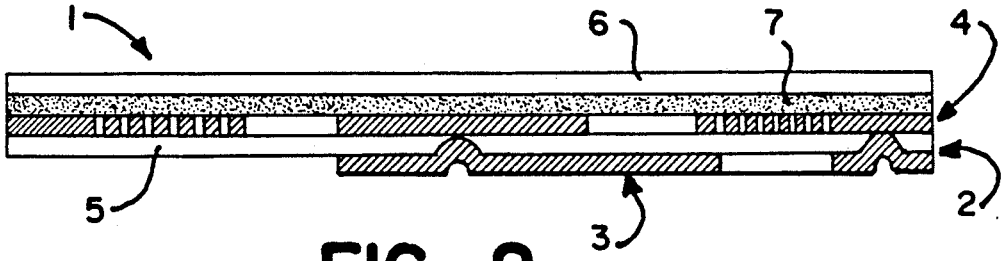
FIG. 2

FIG. 3
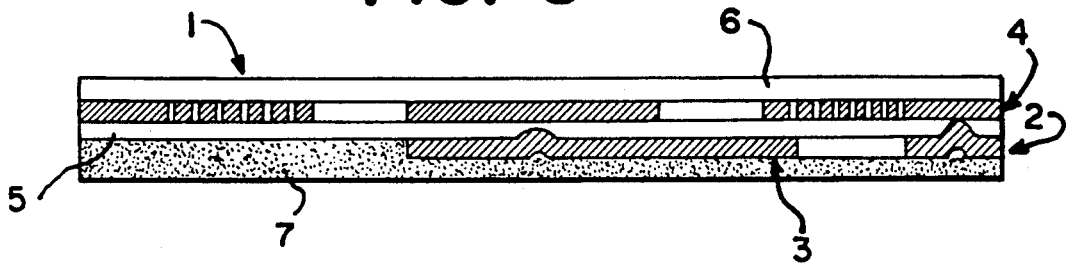
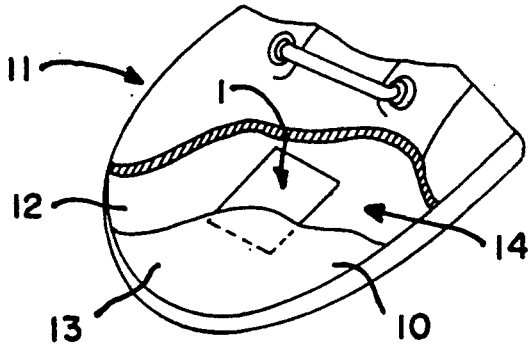
FIG. 4

SYSTEM FOR DEACTIVATING A FIELD-SENSITIVE TAG OR LABEL

BACKGROUND OF THE INVENTION

The present invention relates generally to the field of electronic article surveillance, and in particular, to a system for deactivating the field-sensitive tags or labels which are used in conjunction with such electronic article surveillance systems.

For enhanced security and inventory control, it is becoming increasingly popular for various types of establishments to employ electronic article surveillance systems. Numerous systems have been proposed to accommodate these various applications. However, irrespective of the application involved, such electronic article surveillance systems generally operate upon a common principle. Articles to be monitored are provided with tags or labels (of various different types) which contain a circuit (e.g., a resonant circuit) for reacting with an applied (e.g., radio-frequency) field. A transmitter and a transmitting antenna are provided to develop this applied field, and a receiver and a receiving antenna are provided to detect disturbances in the applied field. If the field-sensitive circuit of a tag is passed between the transmitting and receiving antennas (positioned at the desired verification point), the applied field is affected in such fashion that a detectable event is produced within the receiver. This is then used to produce an appropriate signal, or alarm. Systems of this general type are available from manufactures such as Checkpoint Systems, Inc. of Thorofare, N.J., among others.

The tag (or label) which is used in conjunction with such systems is generally provided with an internally disposed stimulus which is capable of exciting the associated apparatus. This often takes the form of a circuit which is capable of reacting with a specified field to cause the detectable event which is used to provide a warning signal. An example of a tag of this general type, which is useful in connection with an applied radio-frequency field, may be found in U.S. Pat. Nos. 4,567,473 and 4,498,076.

It is presently common practice to manufacture such tags in a fashion which makes them as universal as possible, permitting the tags to receive different markings and to be applied to different types of articles without necessitating the use of a large number of different types of tags for this purpose. This assists in reducing costs, and enhances convenience for the end user. However, it has been found that there are certain applications, involving certain types of articles to be marked, where more specialized tags would be useful.

One such application involves the retail sale of footwear, primarily shoes and the like. It has recently become increasingly popular to sell shoes in retail establishments which are essentially "self-service", eliminating the need for specialized personnel and accordingly reducing the costs of operating an establishment of this type. This necessitates the placement of a large number of shoes in an unattended area, for free consumer access. However, this has the corresponding disadvantage of facilitating the removal of goods from the retail establishment, without having first paid for them. It has therefore become desirable to develop a field-sensitive tag which is especially suited to applications of this general type, and the special problems which such applications present.

SUMMARY OF THE INVENTION

It is therefore the primary object of the present invention to provide a field-sensitive tag or label which is particularly well suited to secured applications involving footwear, primarily shoes and the like.

It is also an object of the present invention to provide a field-sensitive tag of this general type which can provide the various assurances which are expected of an electronic article surveillance system, yet which can be reliably deactivated at the point of sale to avoid false alarms.

It is also an object of the present invention to provide a field-sensitive tag of this general type which is advantageously applied to shoes or other equivalent articles which are to be protected.

It is also an object of the present invention to provide a field-sensitive tag of this general type which is effective in operation, yet not easily detected by shoppers when in use.

These and other objects are achieved in accordance with the present invention by providing a field-sensitive tag or label which further incorporates a layer for mechanically deactivating the tag resulting from subsequent use of the article to which the tag has been applied. To this end, a layered tag is provided which, in addition to the layers which are traditionally provided to achieve the function of a resonant circuit (e.g., substrate and etched outer layers), further incorporates a circuit-deactivating layer which preferably takes the form of an abrasive substance disposed in a suitable binder. The resulting layer can then operate to mechanically deactivate the tag by damaging (at least to the point where the resonant circuit no longer resonates at the operative frequency for the electronic article surveillance system) at least a portion of the resonant circuit which comprises the tag due to movement of the article in subsequent use.

The field-sensitive tag of the present invention is advantageously applied to footwear in regions where flexure of the tag can be anticipated. Placement of the tag in the sole of a shoe is generally preferred since this portion of the shoe can be expected to encounter a significant amount of flexing and applied force. This also has the advantage that the tag is not readily detectable by a shopper, so that the shopper is not alerted to the security measures which have been taken. However, other placements are also possible, if desired.

In use, upon the purchase of a shoe, the tag which it contains is preferably deactivated at the point of sale, in conventional fashion, to permit purchased items to be removed from the retail establishment. However, unlike the more conventional tags or labels which are used in conjunction with security systems of this general type, the tag of the present invention will often be permanently located within the shoe, and therefore will not be removable following the retail transaction. Since it is not uncommon for the resonant circuits which are used to at times become reactivated due to conditions which tend to defeat the measures which were taken to deactivate them (so-called "Lazarus" effect), steps are taken in accordance with the present invention to permanently and mechanically deactivate the resonant circuit through action of the abrasive substance of the tag's deactivating layer. In essence, as the shoe is worn, the resonant circuit is progressively damaged, preventing its reactivation.

The result is a tag which is advantageously applied to footwear, and which is well suited to use in a self-service retail setting. Yet, following a sale, the tag is conveniently and effectively deactivated, to permit the removal of purchased goods from the retail establishment. What is more, the entire procedure is essentially "transparent" to the shopper, since the tag is virtually undetectable. An effective security system particularly well suited to the protection of footwear and the like therefore results.

For further detail regarding a field-sensitive tag produced in accordance with the present invention, reference is made to the detailed description which is provided below, taken in conjunction with the following illustrations.

BRIEF DESCRIPTION OF THE DRAWINGS

FIG. 1 is a top plan view of a field-sensitive tag produced in accordance with the present invention, with portions broken away to reveal internal construction.

FIG. 2 is a cross-sectional view of the field-sensitive tag of 1, taken along the line 2—2.

FIG. 3 is a cross-sectional view similar to FIG. 2, showing an alternative placement for the tag deactivating layer of the present invention.

FIG. 4 is a partial, perspective view illustrating placement of the field-sensitive tag of FIG. 1 in a shoe, with portions broken away to reveal internal construction.

In the several views provided, like reference numerals denote similar structure.

DETAILED DESCRIPTION OF A PREFERRED EMBODIMENT

FIG. 1 illustrates a field-sensitive tag 1 produced in accordance with the present invention. The tag 1 incorporates a resonant circuit 2 which is generally comprised of a pair of etched circuit layers 3, 4 positioned on opposing sides of a supporting substrate 5. The construction of the resonant circuit 2 is generally known to persons of ordinary skill in the art, and therefore need not be described in any particular detail. Paper outer layers 6 are preferably applied to either side of the tag 1, as is also conventional, to receive printed information or to simply cover the layers of the resonant circuit 2, as desired.

In accordance with the present invention, a deactivating layer 7 covers one of the etched circuit layers 3, 4, and is positioned beneath any adjacent paper outer layer 6 which may have been provided, as is best illustrated in FIGS. 2 and 3 of the drawings.

As is conventional, one of the etched circuit layers of the resonant circuit 2 (in this case the etched circuit layer 3) is generally somewhat thinner than the etched circuit layer which is provided on the opposing side of the resonant circuit 2 (i.e., the etched circuit layer 4). This is because the etched circuit layer 3 which constitutes the "capacitor side" of the resonant circuit 2 is generally somewhat thinner than the etched circuit layer 4 which constitutes the "inductor side" of the resonant circuit 2 which is to be developed.

Thus, a placement of the deactivating layer 7 on the inductor side (the etched circuit layer 4) of the resonant circuit 2, as shown in FIGS. 1 and 2, is useful to promote damage to the etched circuit layer 4 through interaction with the relatively fine (and therefore fragile) traces which are formed on the inductor side of the resonant circuit 2, while a placement of the deactivating layer 7 on the thinner, capacitor side (the etched circuit layer 3) of the resonant circuit 2, as shown in FIG. 3, is useful to promote damage to the resonant circuit 2 by interacting with the thinner etched circuit layer 3. Also possible are placements of deactivating layers 7 on both sides of the resonant circuit 2, or on selected portions of the etched circuit layers 3, 4, as desired.

The deactivating layer 7 is comprised of a substance which will interact with the adjacent metallic etched circuit layer of the resonant circuit 2 to physically damage at least a portion of the etched circuit layer, and accordingly, deactivate the field-sensitive tag 1. Such mechanical deactivation is preferably achieved using a deactivating layer 7 which employs an abrasive substance to wear away portions of the contacting etched circuit layer. For example, this may be accomplished by providing a deactivating layer 7 comprised of pumace impregnating a heat seal adhesive. While this or other mechanical means for damaging the etched circuit layer are presently preferred, appropriate chemical means may also be considered.

As a result of the foregoing, as the tag 1 is flexed, interaction between the abrasive deactivating layer 7 and the adjacent etched circuit layer will progressively and mechanically damage at least a portion of the etched circuit layer, eventually permanently deactivating the resonant circuit 2. The degree to which bending of the tag 1 will cause damage to the etched circuit layer will of course vary in accordance with the abrasiveness of the substance disposed within the deactivating layer 7, as well as the amount of bending which the tag 1 encounters. As a result, the rate at which the tag 1 will become deactivated may be varied, as desired. A time-sensitive deactivation could also be developed using a chemically-based deactivating layer 7, if desired.

Although other applications may prove to be of interest, the field-sensitive tag 1 of the present invention is primarily intended for use in conjunction with footwear and the like. FIG. 4 of the drawings schematically illustrates a preferred placement of the tag 1, in the sole 10 of a shoe 11. Such placement is advantageous since the sole 10 of a shoe 11 is commonly formed of two layers 12, 13, which can readily receive the tag 1 between them in the course of manufacturing the shoe 11. A particularly preferred placement for the tag 1 is within portion 14 of the sole 10 which will receive the ball of the wearer's foot, since it is at this position that a maximum amount of pressure and bending can be anticipated, expediting mechanical disruption of the resonant circuit 2 of the field-sensitive tag 1 as previously described. Other placements are possible, although it is presently believed that the assurance of a positive deactivation will be somewhat less when such other placements are employed.

In use, the tag 1 is appropriately placed into the sole 10 of the shoe 11 (either when manufacturing the shoe, or by the retail establishment), thereby permitting the shoe 11 to be freely placed for access by shoppers while maintaining an appropriate degree of security. To be noted is that the tag 1 will not be readily detectable by the shopper, making use of the security system of the present invention unknown, and accordingly, more effective. By selecting an appropriate degree of abrasiveness for the deactivating layer 7, it would then be possible for shoppers to try on the shoe 11, for fit and appearance, while maintaining the effectiveness of the resonant circuit 2 of the tag 1. Upon purchase, the shoe 11 (and the tag 1 which it contains) would then be brought to the point of sale. As part of the retail transaction, positive deactivation of the resonant circuit 2 of the tag 1 would take place in conventional fashion, using available deactivation devices. This is preferred to make sure that the purchased item is immediately made removable from the retail establishment, avoiding false alarms.

Unlike other types of tags, which are more easily removed by the shopper following a purchase, the tag 1 of the present invention will generally form a permanent part of the sole 10 of the shoe 11. Considering this environment, and in particular the continuous flexing which would occur, it could be expected that the steps which are presently taken to deactivate a resonant circuit could later reverse themselves. This could contribute to the triggering of false alarms at a later date. However, the abrasive deactivating layer 7 will now operate to positively and mechanically damage portions of the contacting etched circuit layer of the resonant circuit 2, positively preventing a later reactivation of the tag 1. As a result, an appropriate degree of security is provided, while avoiding unnecessary false alarms. To be noted is that while positive deactivation of the tag 1 is preferred, this is not necessarily required since as the shoe is worn, the deactivating layer 7 will itself operate to positively deactivate the resonant circuit 2 of the tag 1.

It will therefore be understood that although the foregoing serves well to satisfy each of the objectives previously stated, various changes in the details, materials and arrangement of parts which have been herein described and illustrated in order to explain the nature of this invention may be made by those skilled in the art within the principle and scope of the invention as expressed in the claims which follow. Some of these variations have already been discussed. Others will occur to the person of ordinary skill in the art. This will include variations in the construction of the tag 1, and the layers which comprise the tag, as well as variations in the manner in which the deactivating layer 7 of the tag 1 is developed. Also capable of variation is the manner in which the tag 1 of the present invention is employed, and applied to an article to be protected, including both articles of footwear (with which the tag 1 of the present invention is primarily intended for use), as well as other articles which may effectively employ the tag 1 of the present invention, as desired.

What is claimed is:

1. For use in an electronic security system, a field-sensitive tag comprising a resonant circuit, and a deactivating layer in contact with at least portions of said resonant circuit and incorporating means for physically opening a portion of said resonant circuit in contact with said deactivating layer.

2. The tag of claim 1 wherein said resonant circuit comprises circuit-forming metal plates disposed on opposing sides of a substrate, and wherein said deactivating layer is in contact with one of said circuit-forming metal plates.

3. The tag of claim 2 wherein a first circuit-forming metal member on a first side of said substrate is thinner than a second circuit-forming metal member on a second side of said substrate, and wherein said deactivating layer is in contact with said first circuit-forming metal member.

4. The tag of claim 2 wherein a first circuit-forming metal member on a first side of said substrate is thinner than a second circuit-forming metal member including a plurality of traces on a second side of said substrate, and wherein said deactivating layer is in contact with the traces of said second circuit-forming metal member.

5. The tag of claim wherein said resonant circuit further incorporates means for deactivating said resonant circuit responsive to an applied field.

6. The tag of claim 2 which further comprises a paper layer covering said resonant circuit.

7. The tag of claim 1 wherein said deactivating layer is an abrasive.

8. The tag of claim 7 wherein said abrasive is comprised of pumace impregnating a heat seal adhesive.

9. For use in an electronic security system, an article incorporating a field-sensitive tag in accordance with claim 1.

10. The article of claim 9 wherein said article is a shoe.

11. The article of claim 10 wherein said shoe includes a sole which incorporates the field-sensitive tag.

12. The article of claim 11 wherein said fieldsensitive tag is incorporated into the sole of said shoe along portions positioned to accept the ball of a foot.

13. The article of claim 10 wherein said resonant circuit portion is progressively damaged by said deactivating layer when said shoe is flexed.

14. The tag of claim 1 wherein said deactivating layer incorporates means for mechanically or chemically opening said portion of the resonant circuit in contact with the deactivating layer.

15. A method for protecting an article using an electronic security system, comprising:

providing a field-sensitive tag including a resonant circuit, and a deactivating layer in contact with at least portions of said resonant circuit and incorporating means for physically opening a portion of said resonant circuit in contact with said deactivating layer;

positioning said field-sensitive tag within portions of said article to be protected; and deactivating said field-sensitive tag following a purchase of said article by physically opening said portion of the resonant circuit in contact with the deactivating layer.

16. The method of claim 15 wherein said article is a shoe.

17. The method of claim 16 wherein said field-sensitive tag is positioned within the sole of said shoe.

18. The method of claim 15 wherein said fieldsensitive tag is progressively deactivated by said deactivating layer.

19. The method of claim 15 wherein said field-sensitive tag is immediately deactivated by an applied field.

20. The method of claim 15 wherein said portion of the resonant circuit in contact with the deactivating layer is mechanically or chemically opened.

* * * * *